US008596476B2

(12) United States Patent
Caldwell et al.

(10) Patent No.: US 8,596,476 B2
(45) Date of Patent: Dec. 3, 2013

(54) NON-REAPPLYING DISPENSING CLOSURE FOR NON-THREADED FINISHES

(76) Inventors: Craig Caldwell, Slippery Rock, PA (US); Joseph P. Labadie, Perrysburg, OH (US); Lance J. Novotny, Gibsonburg, OH (US); Richard R. Johnston, Toledo, OH (US)

( * ) Notice: Subject to any disclaimer, the term of this patent is extended or adjusted under 35 U.S.C. 154(b) by 975 days.

(21) Appl. No.: 11/923,074

(22) Filed: Oct. 24, 2007

(65) Prior Publication Data

US 2009/0107999 A1 Apr. 30, 2009

(51) Int. Cl.
*B65D 51/00* (2006.01)

(52) U.S. Cl.
USPC ..... 215/252; 215/258

(58) Field of Classification Search
USPC ..... 215/252, 258, 334, 901, 318, 253; 222/153.05, 153.06, 541.6, 541.1; 220/24.3, 258.1
See application file for complete search history.

(56) References Cited

U.S. PATENT DOCUMENTS

| | | | | |
|---|---|---|---|---|
| 3,263,874 A | | 8/1966 | Porter et al. | |
| 3,828,962 A | * | 8/1974 | Atkins | 215/321 |
| 4,131,212 A | * | 12/1978 | Rumball | 215/252 |
| 4,535,904 A | * | 8/1985 | O'Connor et al. | 215/215 |
| 5,009,323 A | * | 4/1991 | Montgomery et al. | 215/252 |
| 5,096,077 A | * | 3/1992 | Odet et al. | 215/211 |
| 5,152,432 A | | 10/1992 | De Laforcade | |
| 5,893,474 A | * | 4/1999 | Herrmann et al. | 215/252 |
| 6,315,160 B1 | | 11/2001 | Gaiser et al. | |
| 2005/0242095 A1 | | 11/2005 | Serrano et al. | |

FOREIGN PATENT DOCUMENTS

| | | |
|---|---|---|
| DE | 3233803 | 3/1984 |
| EP | 0468902 | 1/1992 |
| WO | 00/24643 | 5/2000 |

* cited by examiner

*Primary Examiner* — J. Gregory Pickett
*Assistant Examiner* — Ernesto Grano
(74) *Attorney, Agent, or Firm* — Baker Botts, LLP

(57) ABSTRACT

A container assembly includes a container having an unthreaded finish portion and a closure having a downwardly depending sidewall and blocking structure provided at a lower end of the sidewall for securing the closure on to the unthreaded finish portion. The sidewall is provided with a predetermined area of weakness so that in the event that an attempt is made to remove the closure from the container the predetermined area of weakness will rupture, leaving the closure with insufficient structural integrity to be successfully reapplied to the container. The container assembly has particular utility for use in packaging brand-name comestibles such as ketchup for restaurant use. It will frustrate efforts by the restaurant to replenish the brand-name comestible with a cheaper replacement within a dispensing container that is still labeled with the brand of the original product.

13 Claims, 2 Drawing Sheets

NON-REAPPLYING DISPENSING CLOSURE FOR NON-THREADED FINISHES

BACKGROUND OF THE INVENTION

1. Field of the Invention

This invention relates generally to the field of packaging, and more specifically to dispensing closures that are designed to dispense product from a container having an unthreaded finish portion.

2. Description of the Related Technology

Plastic dispensing closures are in wide use throughout the world for packaging liquid or semi liquid products and in particular for packaging comestible foodstuffs such as ketchup, mustard or syrups. A dispensing closure typically includes structure that permits it to be secured to a finish portion of a mating container, a dispensing orifice and some type of structure such as a fliptop lid for selectively opening and closing the dispensing orifice.

Many dispensing closures are provided with threaded inner surfaces that are constructed and arranged to mate with helical threads that are provided on the finish portion of the container to which they are attached. Such closures however are typically easily removed from the container by simply unscrewing the closure from the finish portion of the container.

In certain packaging applications it is preferred that the closure be constructed so that it is difficult to remove from the container. For example, in the packaging of brand-name comestible foodstuffs such as ketchup and mustard that are intended for restaurant use, the manufacturer has an interest to make sure that the restaurant does not replenish the brand-name product with an inferior substitute by simply removing the dispensing closure, refilling the container and replacing the dispensing closure. The inferior quality of the substitute product would wrongfully be associated in customer's minds with the original brand-name product if this were permitted to occur.

Accordingly, many dispensing closures for such packaging applications are designed to be applied to a container that has an unthreaded finish with retention structure such as an annular flange. These types of dispensing closures typically include some type of locking structure that slips over the retention structure when the closure is originally being applied to the container but that engages an underside of the retention structure after the closure has been applied to the container so as to make it difficult to remove the closure from the container. Unfortunately, however, it is possible using great force to remove many these dispensing closures from the container and to reapply them to the container after the container has been refilled.

A need exists in the packaging industry for a dispensing closure that is designed to be applied to a container having an unthreaded finish portion that may not be reapplied to the container after it has been removed.

SUMMARY OF THE INVENTION

Accordingly, is an object of the invention to provide a dispensing closure that is designed to be applied to a container having an unthreaded finish portion that may not be reapplied to the container after it has been removed.

In order to achieve the above and other objects of the invention, a non-reapplying plastic closure according to a first aspect of the invention includes a main body portion having a downwardly depending sidewall, the sidewall having an inner surface that is shaped to be applied over an unthreaded finish portion of a container having retention structure provided thereon; locking structure provided at a lower end of the sidewall, the locking structure being constructed and arranged to engage the retention structure of the container so as to make it difficult to remove the closure from the container after the closure has been applied to the container; and wherein the sidewall has a predetermined area of weakness defined therein, the predetermined area of weakness being constructed and arranged to rupture in the event that an attempt is made to remove the closure from the container, whereby the closure will lack sufficient structural integrity to be successfully reapplied to the container in the event that the effort to remove the closure from the container is successful.

A container assembly that is constructed according to a second aspect of the invention includes a container having an unthreaded finish portion, the unthreaded finish portion having retention structure provided thereon; and a dispensing closure including a main body portion having a downwardly depending sidewall, the sidewall having an inner surface that is fitted over the unthreaded finish portion and the retention structure; locking structure provided at a lower end of the sidewall, though locking means being engaged with the retention structure of the container so as to make it difficult to remove the closure from the container after the closure has been applied to the container; and wherein the sidewall has a predetermined area of weakness defined therein, though predetermined area of weakness being constructed and arranged to rupture in the event that an attempt is made to remove the closure from the container, whereby the closure will lack sufficient structural integrity to be successfully reapplied to the container in the event that the effort to remove the closure from the container is successful.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
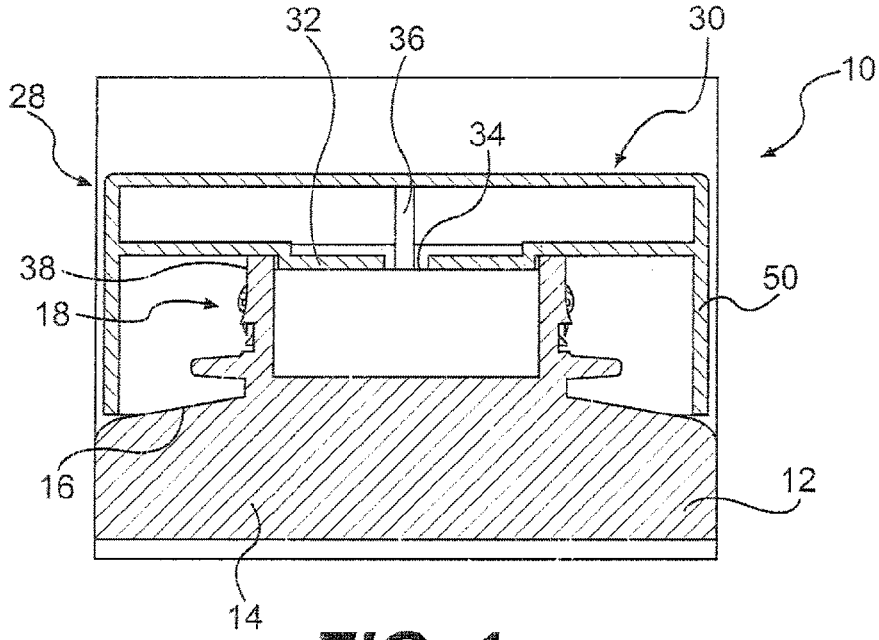
FIG. 1 is a fragmentary cross-sectional view of the container assembly that is constructed according to a preferred embodiment of the invention.

Referring now to the drawings, wherein like reference numerals designate corresponding structure throughout the views, and referring in particular to FIG. 1, a container assembly 10 that is constructed according to a preferred embodiment of the invention includes a container 12 having a main body portion 14, a shoulder portion 16 and an unthreaded finish portion 18.

Figure 2:
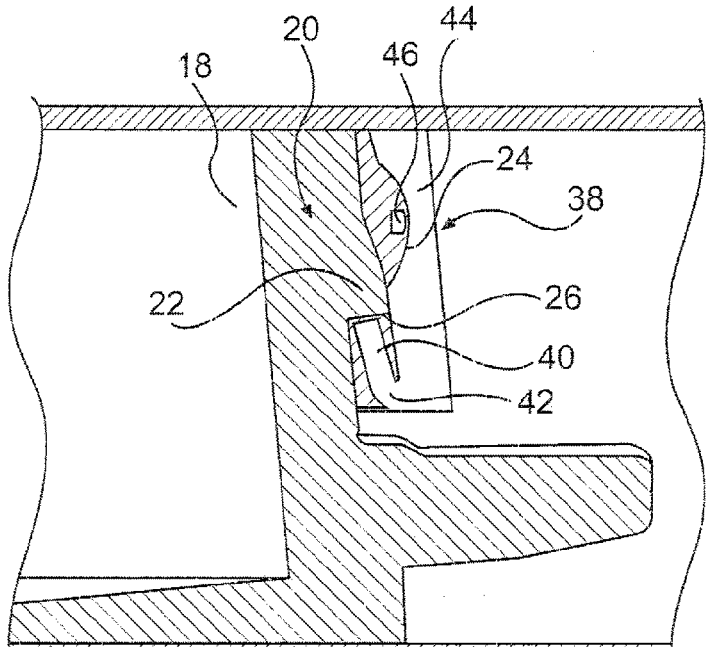
FIG. 2 is an enlarged fragmentary cross-sectional view of a portion of the container assembly that is depicted in FIG. 1.
Figure 3:
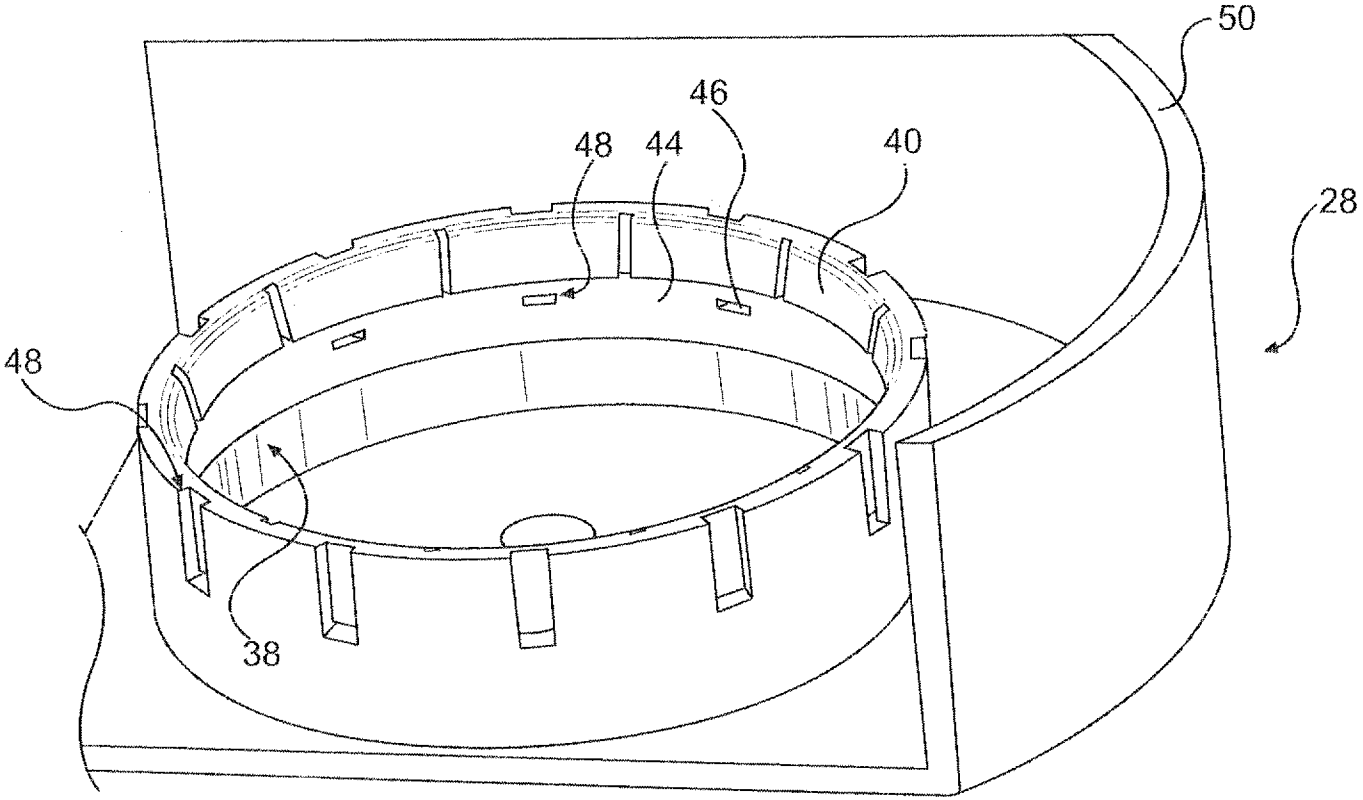
FIG. 3 is a fragmentary perspective view depicting a portion of the container assembly that is depicted in FIG. 1.

Referring briefly to FIG. 2, it will be seen that the unthreaded finish portion 18 preferably includes retention structure 20 that is embodied as an annular flange 22 that extends around the circumference of the outer portion of the finish portion 18 and that preferably includes a gently sloped ramped upper surface 24 and a lower surface 26 that preferably resides within a plane that is substantially perpendicular to a longitudinal axis of the finish portion 18.

Container assembly 10 also includes a dispensing closure 28 having a main body portion 30 that includes an upper wall 32 that is configured to seal against an uppermost portion of the unthreaded finish portion 18 of the container 12. Upper wall 32 has at least one dispensing opening 34 defined therein for dispensing a liquid or a semi liquid product from the container 12. The dispensing closure 28 further includes a plug member 36 that is configured to selectively open and close the dispensing opening 34. The plug member 36 is preferably mounted on a portion of the dispensing closure 28 is configured to move with respect to the main body portion 30, such as a fliptop lid that is connected to the main body portion 30 by means of a flexible hinge. Alternatively, the specific construction of the dispensing closure 28 may vary and the plug member 36 may be connected to a portion of the dispensing closure 28 that is completely removable from the main body portion 30.

Dispensing closure 28 further preferably includes a downwardly depending sidewall 38 that extends downwardly from the main body portion 30 and that is constructed and arranged to tightly fit over the unthreaded finish portion 18. A plurality of flap members 40 are attached to a lowermost portion of the sidewall 38 by means of a corresponding plurality of flexible hinges 42. Distal surfaces of a the flap members are constructed and arranged to bear against the lower surface 26 of the retention structure 20 in order to retain the dispensing closure 28 on to the container 12 after the closure 20 it has been initially applied to the container 12.

In the preferred embodiment, the entire dispensing closure 28 is molded as a single piece of plastic material, including the main body portion 30, the sidewall 38, the flap members 40 and hinge members 42. The plastic material is preferably polyethylene or polypropylene, but could alternatively be any type of plastic material having suitable characteristics.

According to one particularly advantageous feature of the invention, at least a portion of the sidewall 38 of the dispensing closure 28 is fabricated and designed to have a predetermined area of weakness 48 that is specifically designed and configured to rupture in the event that an attempt is made to by a consumer or a commercial user to remove the closure 28 from the container 12. Accordingly, the closure 28 will lack sufficient structural integrity to be successfully reapplied to the container 12 in the event that the effort to remove the closure 28 from the container 12 is successful.

In the preferred embodiment, the predetermined area of weakness 48 includes a portion 44 of the sidewall that has a reduced wall thickness in comparison to adjacent areas of the sidewall 18. This is accomplished in the illustrated embodiment by defining an annular groove in a portion of the inner surface of the sidewall 18. In addition, the predetermined area of weakness 48 preferably includes a plurality of perforations 46 that are defined in the sidewall 18. Perforations 46 may extend all the way through the thickness of the sidewall 18 or alternatively may extend only partially through the thickness of the sidewall 18.

The predetermined area of weakness 48 extends in the preferred embodiment about the entire circumference of the generally cylindrical sidewall 18. Alternatively, a predetermined area of weakness 48 could extend around only a portion of the circumference of the sidewall 18.

Dispensing closure 28 may further include a downwardly depending outer apron 50 that is attached to the main body portion 30 radially outwardly from the generally cylindrical sidewall portion 38. Outer apron 50 preferably extends downwardly into close proximity with the shoulder portion 16 of the container 12, thereby precluding access to the space in which the sidewall 38 and the finish portion 18 are positioned.

The container assembly 10 will typically be assembled at a product packaging plant after the container 12 is filled with a liquid or semi liquid product by pressing the dispensing closure 28 downwardly on to the finish portion 18 so that the flap members 40 slide over the ramped upper surface 24 of the retention structure 20 and become securely seated against the lower surface 26 of the retention structure 20. The filled container assembly 10 is then commercially distributed and will eventually arrive to a retail establishment or a commercial establishment such as a restaurant. The product will be dispensed from the container assembly 10 in a conventional manner.

If the container assembly 10 is being used at a commercial establishment such as a restaurant and the manager of the establishment desires to refill the container assembly 10, he or she may attempt to remove the dispensing closure 28 from the container 12 by prying the dispensing closure 28 upwardly relative to the container 12 using great force. In the past, it was possible to remove conventional dispensing closures from the container, refill the container and reapply the dispensing closure without adversely impacting the functionality of the container assembly. However, any such efforts to remove the dispensing closure 28 from the container 12 will result in a rupture of the predetermined area of weakness 48 that is provided on the sidewall 38 of the dispensing closure 28. This will destroy the functionality of the dispensing closure 28 and make it impossible to successfully reapplied the dispensing closure 28 to the container 12 after refilling the container 12.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A non-reapplying plastic closure, comprising:

a main body portion having a downwardly depending sidewall, said sidewall having an inner surface that is shaped to be applied over an unthreaded finish portion of a container having retention structure provided thereon;

locking means provided at a lower end of said sidewall, said locking means being constructed and arranged to engage the retention structure of the container so as to make it difficult to remove said closure from the container after the closure has been applied to the container; and wherein said sidewall has a predetermined area of weakness defined therein, said predetermined area of weakness being constructed and arranged to rupture in the event that an attempt is made to remove the closure from the container, the predetermined area of weakness being located in a portion of the sidewall so that the closure will lack sufficient structural integrity to be successfully reapplied to the container in the event that the effort to remove the closure from the container is successful, and further wherein said predetermined area of weakness is defined by a portion of the sidewall that has a reduced thickness with respect to adjacent portions of the sidewall.

2. The non-reapplying plastic closure according to claim 1, wherein said sidewall is generally cylindrical in shape and has a circumference, and wherein said predetermined area of weakness extends substantially about said entire circumference.

3. The non-reapplying plastic closure according to claim 1, wherein said predetermined area of weakness comprises a plurality of perforations that are defined in said sidewall.

4. The non-reapplying plastic closure according to claim 1, wherein said predetermined area of weakness comprises a plurality of perforations that are defined in said sidewall.

5. The non-reapplying plastic closure according to claim 4, wherein said perforations are defined in the portion of the sidewall that has a reduced thickness.

6. The non-reapplying plastic closure according to claim 1, wherein said locking means comprises a plurality of flap members, each of said flap members being hingedly attached to a lower portion of said sidewall, said flap members engaging an underside of the retention structure of the container so as to resist any upward movement of the closure with respect to the container.

7. The non-reapplying plastic closure according to claim 1, wherein said main body portion further comprises an outer apron that is radially spaced from said sidewall, said outer apron being constructed and arranged to extend outwardly into proximity with a shoulder of the container, whereby a consumer is precluded from touching said sidewall when said closure is attached to the container.

8. A container assembly, comprising:

a container having an unthreaded finish portion, said unthreaded finish portion having retention structure provided thereon; and a dispensing closure, said dispensing closure comprising:

a main body portion having a dispensing opening defined therein;

the main body portion further comprising a downwardly depending sidewall, said sidewall having an inner surface that is fitted over said unthreaded finish portion and said retention structure;

locking means provided at a lower end of said sidewall, said locking means being engaged with the retention structure of the container so as to make it difficult to remove said closure from the container after the closure has been applied to the container; and wherein said sidewall has a predetermined area of weakness defined therein, said predetermined area of weakness being constructed and arranged to rupture in the event that an attempt is made to remove the closure from the container, the predetermined area of weakness being located in a portion of the sidewall so that the closure will lack sufficient structural integrity to be successfully reapplied to the container in the event that the effort to remove the closure from the container is successful; further wherein said predetermined area of weakness is defined by a portion of the sidewall that has a reduced thickness with respect to adjacent portions of the sidewall; and wherein said container further includes a shoulder portion that is positioned outwardly and beneath said finish portion, and wherein said main body portion further comprises an outer apron that is radially spaced from said sidewall, said outer apron being constructed and arranged to extend outwardly into proximity with said shoulder portion, whereby a consumer is precluded from touching said sidewall when said closure is attached to the container.

9. The container assembly according to claim 8, wherein said sidewall is generally cylindrical in shape and has a circumference, and wherein said predetermined area of weakness extends about said entire circumference.

10. The container assembly according to claim 8, wherein said predetermined area of weakness comprises a plurality of perforations that are defined in said sidewall.

11. The container assembly according to claim 8, wherein said predetermined area of weakness comprises a plurality of perforations that are defined in said sidewall.

12. The container assembly according to claim 8, wherein said locking means comprises a plurality of flap members, each of said flap members being hingedly attached to a lower portion of said sidewall, said flap members engaging an underside of the retention structure of the container so as to resist any upward movement of the closure with respect to the container.

13. The container assembly according to claim 11, wherein said perforations are defined in the portion of the sidewall that has a reduced thickness.

* * * * *